United States Patent [19]

Murphy

[11] Patent Number: 4,471,960

[45] Date of Patent: Sep. 18, 1984

[54] PUZZLE HAVING A PLURALITY OF SELECTIVE SCENES

[75] Inventor: Charles F. Murphy, Los Angeles, Calif.

[73] Assignee: Intervisual Communications, Inc., Los Angeles, Calif.

[21] Appl. No.: 417,039

[22] Filed: Sep. 13, 1982

[51] Int. Cl.[3] ..... A63F 9/10

[52] U.S. Cl. ..... 273/157 R; 446/118; 273/155

[58] Field of Search ..... 273/155, 157 R, 287; 46/30, 31; 434/402, 403, 172; 40/503, 504

[56] References Cited

U.S. PATENT DOCUMENTS

| | | | |
|---|---|---|---|
| 1,257,432 | 2/1918 | Wetzel | 273/157 R |
| 1,709,660 | 4/1929 | De Bracht | 273/157 R |
| 1,784,364 | 12/1930 | Von Der Lippe-Lipski | 273/155 UX |
| 2,327,471 | 8/1943 | Tiers | 434/172 |
| 2,832,100 | 4/1958 | Swallert | 46/31 X |
| 3,462,857 | 8/1969 | Glass et al. | 273/155 UX |

FOREIGN PATENT DOCUMENTS

| | | | |
|---|---|---|---|
| 761881 | 11/1956 | United Kingdom | 273/155 |

*Primary Examiner*—Anton O. Oechsle
*Attorney, Agent, or Firm*—Gerald L. Price

[57] ABSTRACT

A puzzle comprised of a plurality of elongated pieces, each piece having a plurality of sides presenting a portion of a scene on each side, the puzzle including a knockdown stand adapted to hold said pieces in a contiguous relationship with selective sides of said pieces in a face up relationship so that when all of the sides are aligned on the stand so that all of the portions of the same scene face upwardly and are in proper contiguous relationship a scene is presented. Differing sides of the pieces may be aligned contiguously and facing upwardly so that a different scene is presented.

5 Claims, 7 Drawing Figures

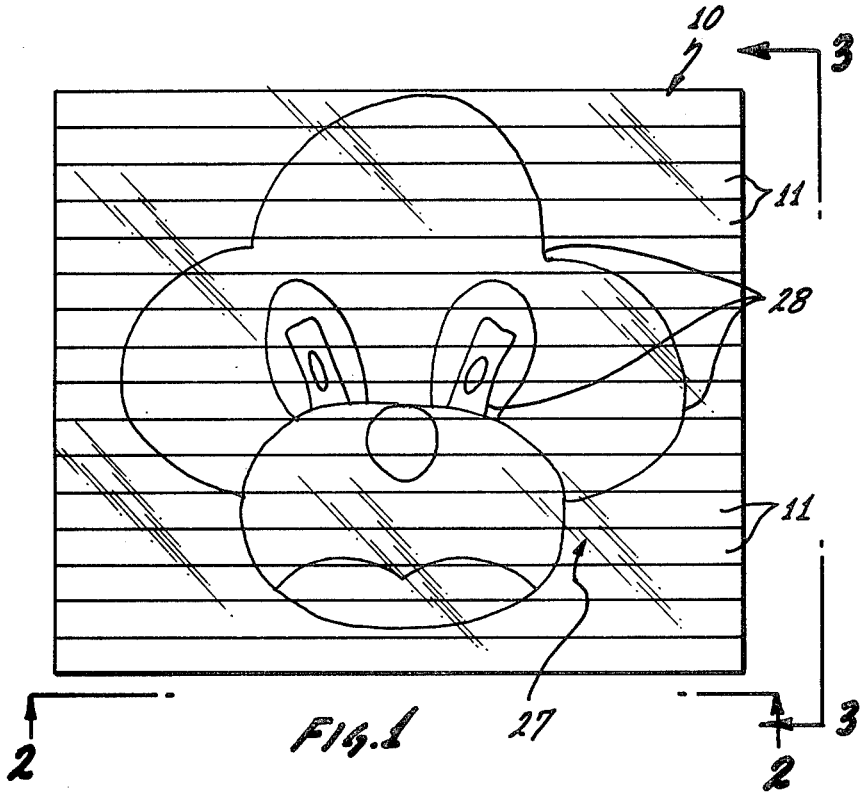
FIG. 1
FIG. 2
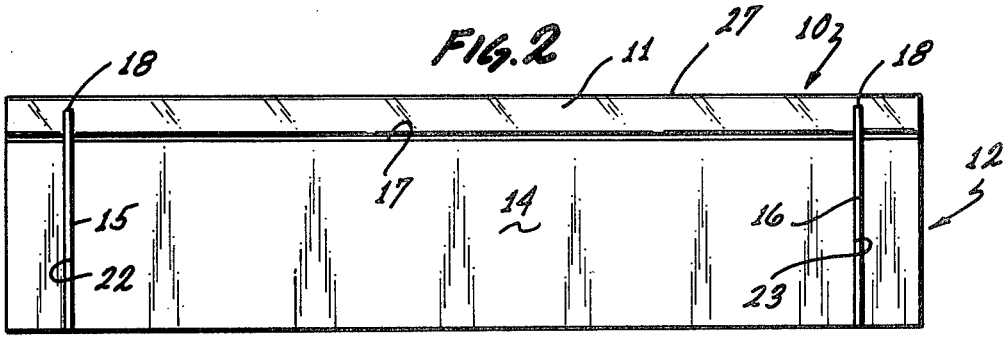
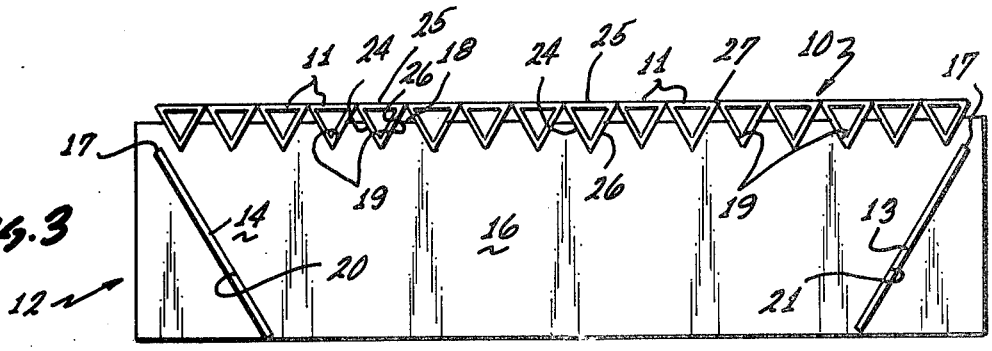
FIG. 3

PUZZLE HAVING A PLURALITY OF SELECTIVE SCENES

BACKGROUND OF THE INVENTION

1. Field of the Invention

The invention relates to puzzles; and, more particularly, to a puzzle comprised of a stand and a plurality of elongated pieces having a plurality of sides, each side comprising a different part of a like number of scenes.

2. Description of the Prior Art

Puzzles have provided an amusing diversion for many years. Usually, such puzzles are comprised of a plurality of interlocking pieces which, when properly interconnected, form a scene or the like. Once one solves this type of puzzle, there is little interest in repeating it since only the same scene can be solved.

In U.S. Pat. No. 287,352 to Ward, a plurality of pyramid-shaped pieces are mounted in a tray, each piece having differing indicia on its faces so that, when like faces are presented to view, a different arrangement of signs, names or drawing is presented. Such pieces form an irregularly shaped scene and thus is not conductive to present-day manufacturing techniques where a planar scene is desired. Further, the pieces and tray must be machined carefully to provide proper alignment of the pieces in the tray.

There is thus a need for a puzzle which can be quickly and easily varied to present different planar scenes that must be solved. Such a puzzle should be simple to manufacture and package and provide sufficient interest so that the user can use it to solve a differing puzzle.

SUMMARY OF THE INVENTION

It is ab object of the invention to provide a puzzle which is comprised of a plurality of loose pieces having differing faces thereon, each face forming part of a scene so that a number of different scenes can be made from the same puzzle pieces.

It is a further object of this invention to provide a puzzle having a stand holding the playing pieces in a contiguous relationship presenting a planar scene when the pieces are properly aligned.

These and other objects are preferably accomplished by providing a puzzle comprised of a plurality of loose elongated playing pieces, each piece having a plurality of sides presenting a portion of a scene on each side, the puzzle including a knockdown stand adapted to hold said pieces in a contiguous relationship with selective sides of said pieces in a face up relationship so that when all of the sides are aligned on the stand so that all of the portions of the same scene face upwardly and are in proper contiguous relationship, a scene is presented. Differing sides of the pieces may be aligned contiguously and facing upwardly so that a different scene is presented.

BRIEF DESCRIPTION OF THE DRAWING

FIG. 1 is a top plan view of the puzzle of the invention;

FIG. 2 is a view taken along lines II—II of FIG. 1;

FIG. 3 is a view taken along lines III—III of FIG. 1;

DESCRIPTION OF THE PREFERRED EMBODIMENT

Figure 4:
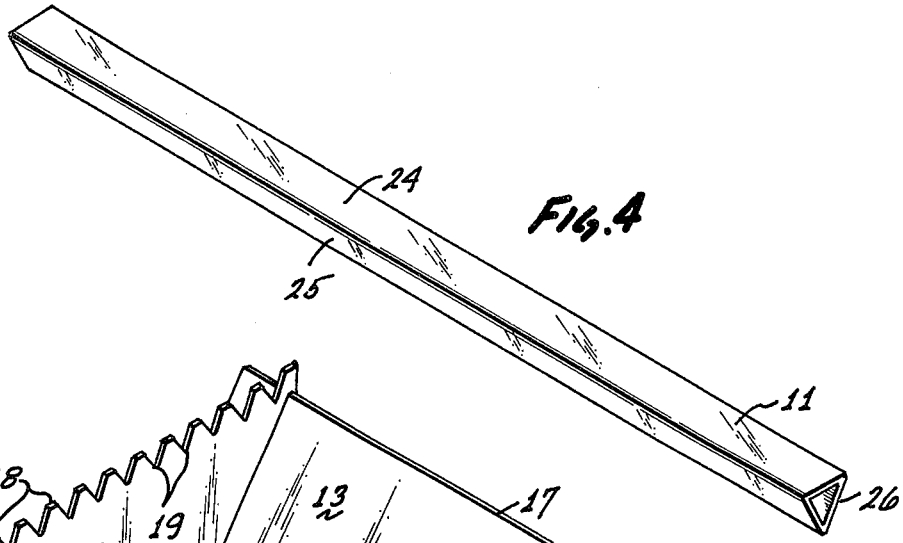
FIG. 4 is a perspective view of one of the pieces alone of the puzzle of FIGS. 1 through 3.

Referring now to FIG. 1 of the drawing, a puzzle 10 in accordance with the invention is shown. Puzzle 10 is comprised of a plurality of elongated playing peices 11 (see also FIG. 4) mounted on a frame or stand 12 (FIG. 5).

Figure 5:
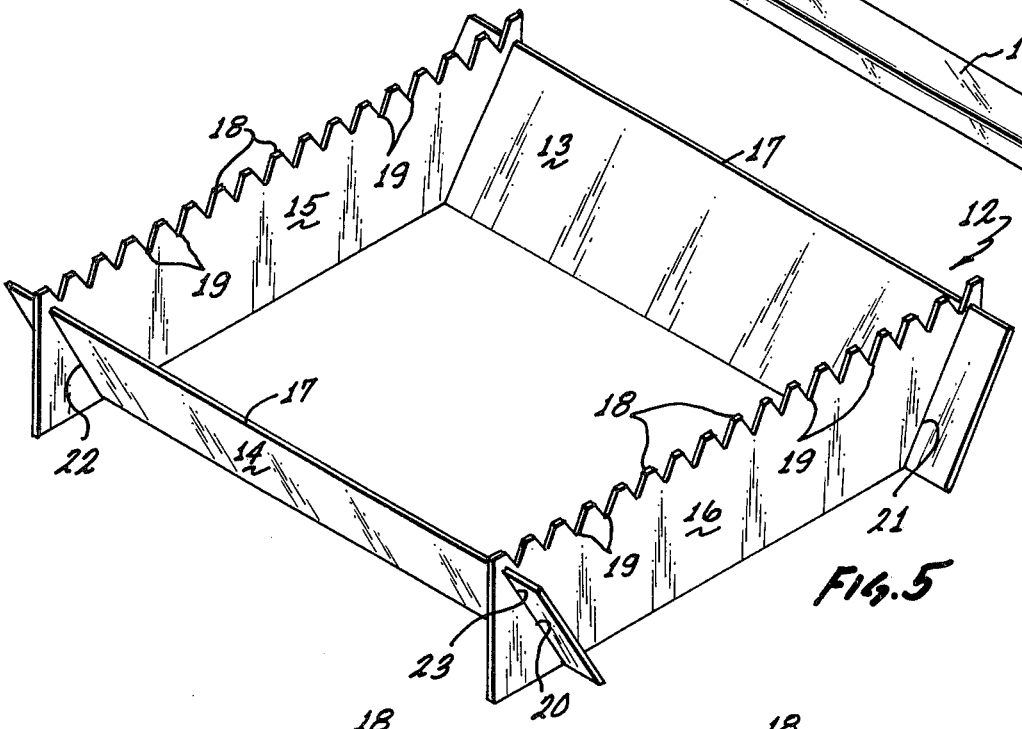
FIG. 5 is a perspective view of the stand alone of the puzzle of FIGS. 1 through 3.

Stand 12 may be a unitary unit, as shown in FIG. 5, having a pair of elongated sides 13,14 interconnected by a pair of elongated sides 15,16. The top edges of sides 13,14 present a top flat surface 17 whereas the top edges of sides 15,16 present serrated edges 18. Edges 18 are comprised of a plurality of triangular-shaped spaced grooves 19. Grooves 19 in wall 16 are horizontally aligned with grooves 19 in wall 15.

Figure 6:
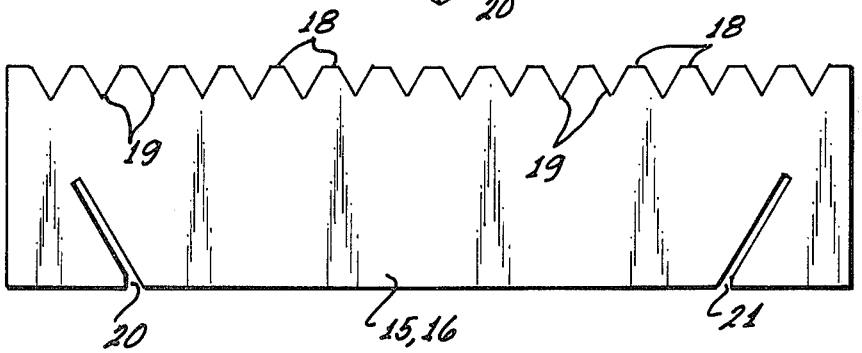
FIG. 6 is a vertical view of one of the sides of the stand of FIG. 5.
Figure 7:
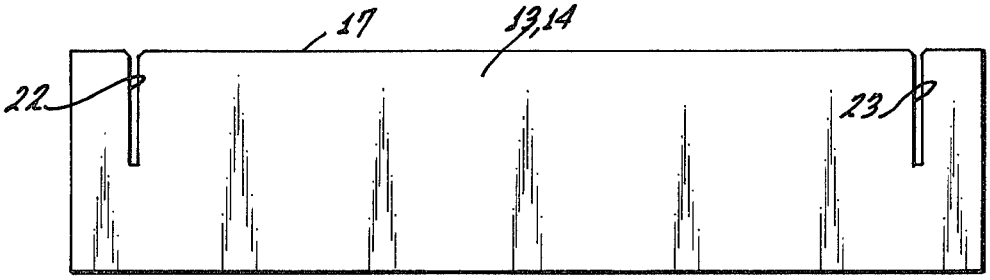
FIG. 7 is a vertical view of the other side of the stand of FIG. 5.

Although stand 12 of FIG. 5 may be a unitary unit, it is preferably comprised of knockdown sections. Thus, as shown in FIGS. 6 and 7, walls 14 and 16, identical to walls 13 and 15, respectively, are shown in plan view. Wall 16 (FIG. 6) is preferably a flat planar section of a rigid material, such as plastic, wood or cardboard, with a pair of spaced angled cut-out slots 20,21.

As seen in FIG. 7, section 14 is preferably also of a rigid material, such as plastic, wood or cardboard, having a pair of vertical cut-out slots 22,23. Slots 22,23 are essentially the same length as slots 20,21.

In assembling stand 12, sections 14 are held in upright position with slots 22,23 facing upwardly. The slots 20,21 of sections 15,16 are inserted into slots 22,23 (e.g., slot 20 into slot 22, slot 21 into slot 23) thereby interlocking the sections to form the rack or stand 12 of FIG. 5.

One of the elongated playing pieces 11 is shown in FIG. 4. Each piece 11 is generally triangular in cross-section thereby having a plurality of sides or faces 24,25 and 26 having indicia thereon. Each piece 11 is preferably at least as long as the spacing between walls 15 and 16 (FIG. 5).

As seen in FIG. 3, the pieces 11 are disposed in aligned grooves 19 thereby presenting a flat upper surface 27 (see also FIG. 1).

As particularly seen in FIG. 1, when pieces 11 are properly aligned on frame 14, a discrete image 28 is visible according to the indicia on the faces of the pieces 11. Of course, this image 28 may vary and depict any desired scene or pictorial representation, such as a computer printout image, a pastoral scene, a photographic reproduction, kaleidoscope, etc.

Referring again to FIG. 4, each side or face 24 through 26 may have thereon a portion of a different scene. That is, face 24 may be a part of one scene, face 25 a second different scene and face 26 a third different scene.

When properly aligned in frame 14, as shown in FIG. 1, all of one set of faces, such as faces 24, form one scene and proper rearrangement of pieces 11 in FIG. 1, such as presenting faces 25 upwardly and in proper order, would result in a different scene.

Obviously, the pieces must also be aligned in the proper contiguous relationship (even though, for example, all of the pieces present the same face upwardly) or the scene will be the correct one but the arrangement of the pictorial representation would be wrong. By selecting scenes of similar style, color or subject matter, or combination thereof, the puzzle can be made as difficult as desired since all faces of each piece might look as if it belonged in the same scene.

Of course, the number of pieces and size thereof may by varied. Although disclosed as triangular thereby presenting three differing faces, and grooves 19 thus also triangular, obviously the pieces may be multi-faced, e.g., four, five, six-sided, etc., with grooves 19 configured accordingly. This of course results in a like number of differing scenes. Also, all of the pieces 11 are preferably of the same length and width and thickness to add to the difficulty of solving the puzzle.

Although the pieces and support may be of any suitable materials, the entire puzzle may be made of cardboard and packaged so that the pieces and sections 13 through 16 fit neatly into a single container. For example, a triangular shaped elongated container may be provided with pieces 11 and sections 13 through 16 fitting into the container in a neat package.

It can thus be seen that there is disclosed a puzzle that is simple and easy to manufacture and presents a plurality of differing scenes.

I claim:

1. A knockdown puzzle comprising a plurality of elongated puzzle peices each including a plurality of generally planar faces which in predetermined combination with other like pieces cooperate to form a picture pattern when said puzzle pieces are arranged in generally side-by-side relationship with their respective longitudinal axis in parallel with each other, support means for retaining said puzzle pieces in said side-by-side relation and including two pairs of interlocking elements cooperatively defining a generally rectangular base, the element in each pair of elements being substantially indentical with its counterpart and including interlocking means for interconnecting the elements of one pair with the elements of the other pair to define said support, the elements of said first pair each having generally parallel side edges interrupted on one edge by a pair of generally parallel slots extending into the element body one slot spaced from and generally parallel with each end of said element, the elements of said second pair of support elements each including generally parallel longitudinal side edge portions, one edge of which is regularly interrupted by a sequence of recesses complementary to the configuration of said puzzle pieces to support said puzzle peices in side-by-side abutting relation and position one side of each of said puzzle pieces in an upward planar panel relation, the opposite edge of said second pair of support elements each containing a pair of angularly converging slots extending into the body of the element and configured to cooperate with the parallel slots in said first pair of support elements to interlock said pairs of support elements together to define said support for said puzzle pieces with said pairs of support elements being angularly related to each other in two separate planes at each of their respective points of interconnection.

2. In the puzzle of claim 1 wherein each place is generally rectangular, and triangular in cross section thereby having three elongated faces, each face having indicia thereon comprising a portion of a scene, the three faces having portions of three differing scenes thereon.

3. In the puzzle of claim 1 wherein each of said pieces is generally rectangular, and triangular in cross section thereby having three elongated faces, each face having indicia thereon comprising a portion of a scene, the three faces having portions of differing scenes thereon, and said grooves are also triangular thereby receiving said pieces therein.

4. In the puzzle of claim 3 wherein all of said pieces are of substantially the same overall length, width and thickness.

5. In the puzzle of claim 1 wherein said pieces and said support are made of cardboard.

* * * * *